US007429932B1

(12) United States Patent
Newell et al.

(10) Patent No.: US 7,429,932 B1
(45) Date of Patent: Sep. 30, 2008

(54) REMOTE CONTROL CODE SET IDENTIFICATION SYSTEM

(75) Inventors: Mark St. John Newell, Seattle, WA (US); John E. Elsbree, Redmond, WA (US); Michelle V. Niethammer, Bellevue, WA (US); Colby D. Boles, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 92 days.

(21) Appl. No.: 10/881,618

(22) Filed: Jun. 30, 2004

(51) Int. Cl.
*G08C 19/00* (2006.01)

(52) U.S. Cl. ..... 340/825.69; 340/825.72; 340/825.22; 340/5.61; 340/5.64; 341/176; 348/734

(58) Field of Classification Search ..... 340/825.69, 340/825.72, 825.22, 5.61, 5.64; 341/176; 348/734
See application file for complete search history.

(56) References Cited

U.S. PATENT DOCUMENTS 4,750,118 A * 6/1988 Heitschel et al. ..... 700/90
5,635,913 A * 6/1997 Willmott et al. ..... 340/825.22
5,949,349 A * 9/1999 Farris et al. ..... 340/5.26
6,031,465 A * 2/2000 Burgess ..... 340/5.54
6,597,374 B1 * 7/2003 Baker et al. ..... 715/717
6,738,485 B1 * 5/2004 Boesen ..... 381/312
6,975,203 B2 * 12/2005 Brookbank et al. ..... 340/5.26
2005/0242970 A1 * 11/2005 Blaker et al. ..... 340/870.07

* cited by examiner

*Primary Examiner*—Brian Zimmerman
*Assistant Examiner*—Vernal Brown
(74) *Attorney, Agent, or Firm*—Westman, Champlin & Kelly, P.A.

(57) ABSTRACT

The present invention greatly enhances the user experience when the user is attempting to "teach" an electronic control device the code set used by a remote control unit. In one embodiment, the user is simply instructed to depress a button on the remote control unit. The electronic control device captures the overall waveform of the transmission corresponding to the code representing the depressed button and matches it against codes found in a code set database. If a unique match is found, the full code set data describing the matched code set is retrieved from the code set database and is used by the first electronic control device.

22 Claims, 12 Drawing Sheets

REMOTE CONTROL CODE SET IDENTIFICATION SYSTEM

BACKGROUND OF THE INVENTION

The present invention relates to systems controlled by remote control units. More specifically, the present invention relates to a system for identifying a code set used to control a device with a remote control unit.

Currently, many electronic devices are controlled with remote control units. The remote control units typically emit electromagnetic radiation, of some type, which is detected by the electronic device to be controlled. The electromagnetic transmissions from the remote control unit contain a control code which is captured by the electronic device and used to control the electronic device.

For instance, one typical remote control unit receives a user input (such as when a user presses a button on the remote control unit) and transmits a control code corresponding to the user input by encoding the control code in an infrared transmission which is emitted by the remote control unit. The electronic device (which may typically be one of a wide variety of electronic devices, such as a television set, DVD player, CD player, etc.) contains an infrared receiver that receives the infrared transmission from the remote control unit and converts it into the digital control code represented by the infrared transmission. The digital code is used in controlling the electronic device as desired by the user.

A number of problems are presented by such systems. Typically, a plurality of different electronic devices are used in a home. For instance, a home may have a television set, a set top box, a DVD player, etc., all from different manufacturers, and all of which are controlled by different remote control units. The infrared code sets used by each of the remote control units to represent user inputs will typically differ, based on the manufacturer of the electronic device. In other words, the specific code representing depression of the number five button (for instance) on the remote control keypad may differ from one remote control unit to the next, based on the manufacture of the remote control unit. In fact, the code sets can even differ based on specific models or electronic devices made by a single manufacturer.

However, it may also be desirable for the user to be able to control all of the electronic devices with a single remote control unit. For instance, and by way of example only, the user may wish to control the set top box and the television set with a "universal remote control unit", which can be used in different modes to control the different electronic devices.

The user may also wish to have a media computer that controls the electronic devices. For instance, if a user wishes to record a television program when the user is not present, the user may program a media computer to automatically change the channel of the set top box to the desired channel, and to record the television program at a predetermined time.

In either of these two scenarios, another device (either the universal remote control or the media computer), which is separate from the remote control unit that came with the set top box must be programmed with the code set used by the remote control unit that came with the set top box. In the past, this has not been an easy task. It has required the user to somehow identify the code set used to control the electronic device (e.g., the code set used by the set top box remote) to the universal remote or media computer.

One prior art scenario for identifying the code set corresponding to an electronic device is to allow the user to select a code set from a relatively lengthy database of potential code sets. For example, in traditional systems where a universal remote control is being trained to work with a television set, the user is instructed to choose a code set from a printed index of manufacturers or codes. This is often an arduous process. Similarly, any given manufacturer may have a plurality of different code sets it uses for different models of electronic devices. Therefore, such a scenario can take an undesirable amount of time and is error prone.

Similarly, if the correct code set cannot be found in the printed index, the user is simply out of luck or is required to train the discrete commands of the universal remote control unit on a one-by-one basis. This latter process (where the universal remote control is required to learn the IR code set) is also cumbersome and error prone. In such prior learning processes, the user is typically required to carefully align the universal remote control unit with the remote control unit for the television set (or other electronic devices). The user is then required to place the universal remote control unit in a learning mode, and then to activate the various buttons on the remote control unit corresponding to the television set, such that the infrared transmissions from the remote control unit corresponding to the television set can be captured and learned by the universal remote control unit and stored for later use.

The circuitry used in this conventional learning process is quite sensitive. For instance, the infrared code sets of different manufacturers are transmitted using different carrier frequencies. Therefore, not only must the universal remote control learn the overall wave shape of the infrared transmission corresponding to each control code, but it must also discern, to a fairly high degree of accuracy, the carrier frequency used for transmitting the overall waveform. Thus, the two remote control units must not only be carefully aligned, but also must conventionally be placed very close to one another (such as within one or several inches of one another). Of course, this type of system is highly error prone as well.

There are a variety of other disadvantages associated with prior IR learning systems as well. For instance, when in the learning mode, the user may forget which buttons have already been learned by the universal remote, and may inadvertently re-enter some buttons or may skip some buttons. Similarly, if the remote control units are moved slightly out of alignment during the learning process, the codes may be erroneously learned. These errors will typically not be known by the user until the entire learning process has been completed and the user attempts to control the electronic device using the universal remote control. Only then will the user realize that learning was unsuccessful, and the entire learning process will normally need to be repeated.

SUMMARY OF THE INVENTION

The present invention greatly enhances the user experience when the user is attempting to "teach" an electronic control device the code set used by a remote control unit. In one embodiment, the user is simply instructed to depress a button on the remote control unit. The electronic control device captures the overall waveform of the transmission corresponding to the code representing the depressed button and matches it against codes found in a code set database. If a unique match is found, the full code set data describing the matched code set is retrieved from the code set database and is used by the electronic control device.

In one illustrative embodiment, the electronic control device corresponds to a universal remote control unit, or a media control computer. Also, in one embodiment, the remote control and the electronic control device can both control another device. The other device may illustratively be a set top box, a DVD player, a television set, an audio device player, or any other type of electronic device that can be controlled by a remote control unit.

In one embodiment, where a plurality of code sets are matched, the matching code sets are analyzed to determine whether a secondary button depression can be input by the user in order to disambiguate the matching codes. If so, the user is directed to depress that button which will disambiguate the matched codes sets.

One embodiment of the present invention also includes a learning mode during which the code set is learned, when the code set is not located in the code set database during the matching process. In that embodiment, the user is requested to depress buttons on the remote control unit so that they can be learned by the electronic control device.

In one embodiment, the user is requested to repeat button depressions such that data can be verified during the learning process. In another embodiment, the data received from the remote control unit based on a user depression of a button is compared against previously learned buttons to ensure that the user is not using the wrong remote control unit, or to ensure that the user is not unnecessarily repeating button depressions which have already been learned.

DETAILED DESCRIPTION OF ILLUSTRATIVE EMBODIMENTS

The present invention relates to a system which is to identify and use a remote control code set in order to control an electronic device. However, before describing the present invention in greater detail, one illustrative embodiment of a computing device which can be used in accordance with the present invention will be described.

Figure 1:
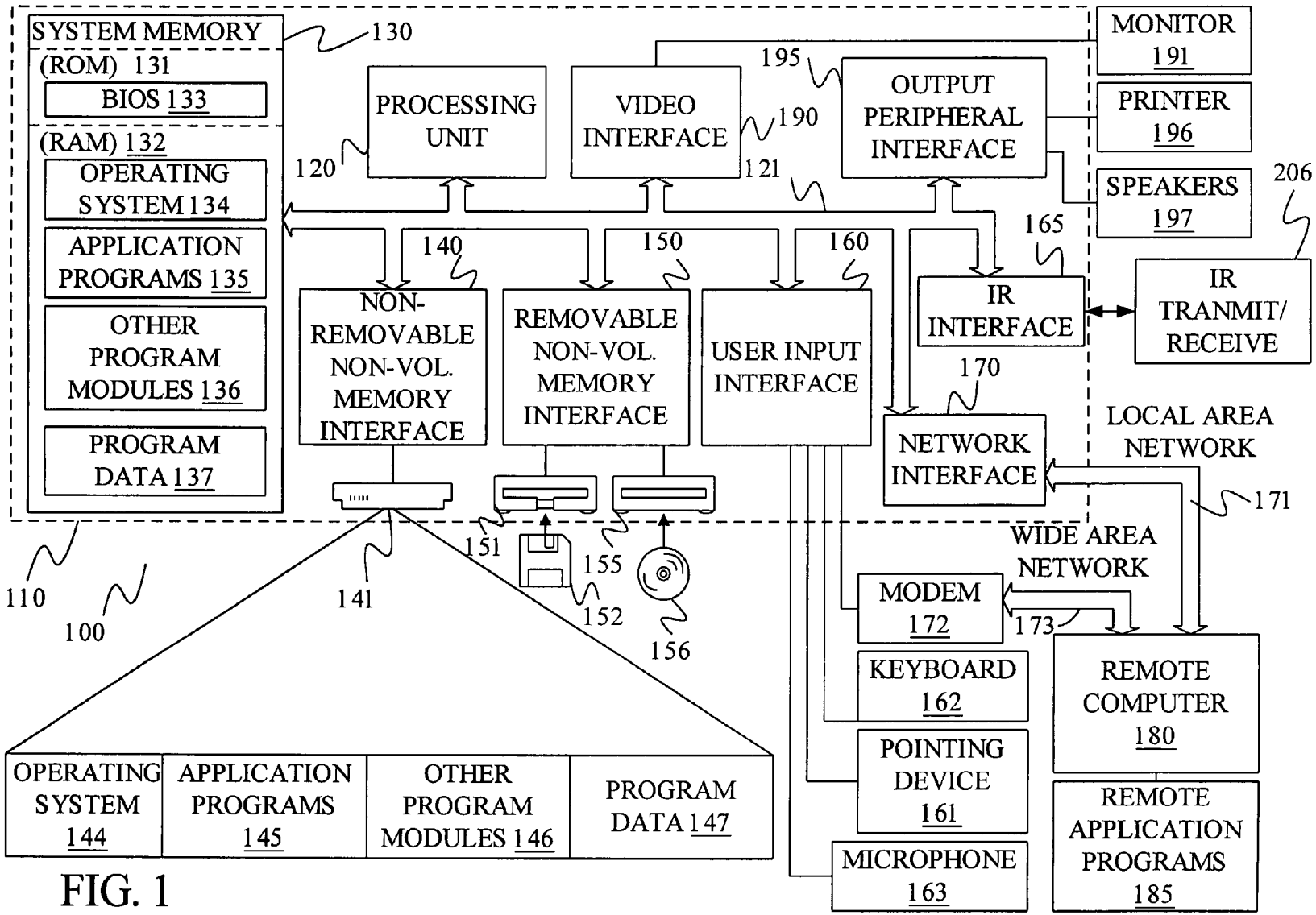
FIG. 1 is a block diagram of one illustrative embodiment of a computer which can be used in accordance with the present invention.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 100. Communication media typically embodies computer readable instructions, data structures, program modules or other data in a modulated data signal such as a carrier WAV or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, FR, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way o example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190. As a replacement for the monitor or in addition to the monitor, a television may be connected through output interface 195 or video interface 190. Examples of possible television technologies include analog, plasma, projection, and LCD.

Computer 110 also includes an Infrared (IR) interface 165 that allows communication between an IR transmitter and receiver 206 and computer 110. In some embodiments, IR transmitter and receiver 206 converts an analog IR signal into an analog electrical signal. This analog signal is passed directly through IR interface 165 to other components of computer 110.

IR interface 165 also acts as a driver for IR transmitter 206. In this capacity, IR interface 165 converts digital values from computer 110 into analog electrical signals. These analog signals drive IR transmitter 206, causing the transmitter to emit an IR signal that matches the analog electrical signal.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user-input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

It should be noted that the present invention can be carried out on a computer system such as that described with respect to FIG. 1. However, the present invention can be carried out on a server, a computer devoted to message handling, or on a distributed system in which different portions of the present invention are carried out on different parts of the distributed computing system.

Figure 2:
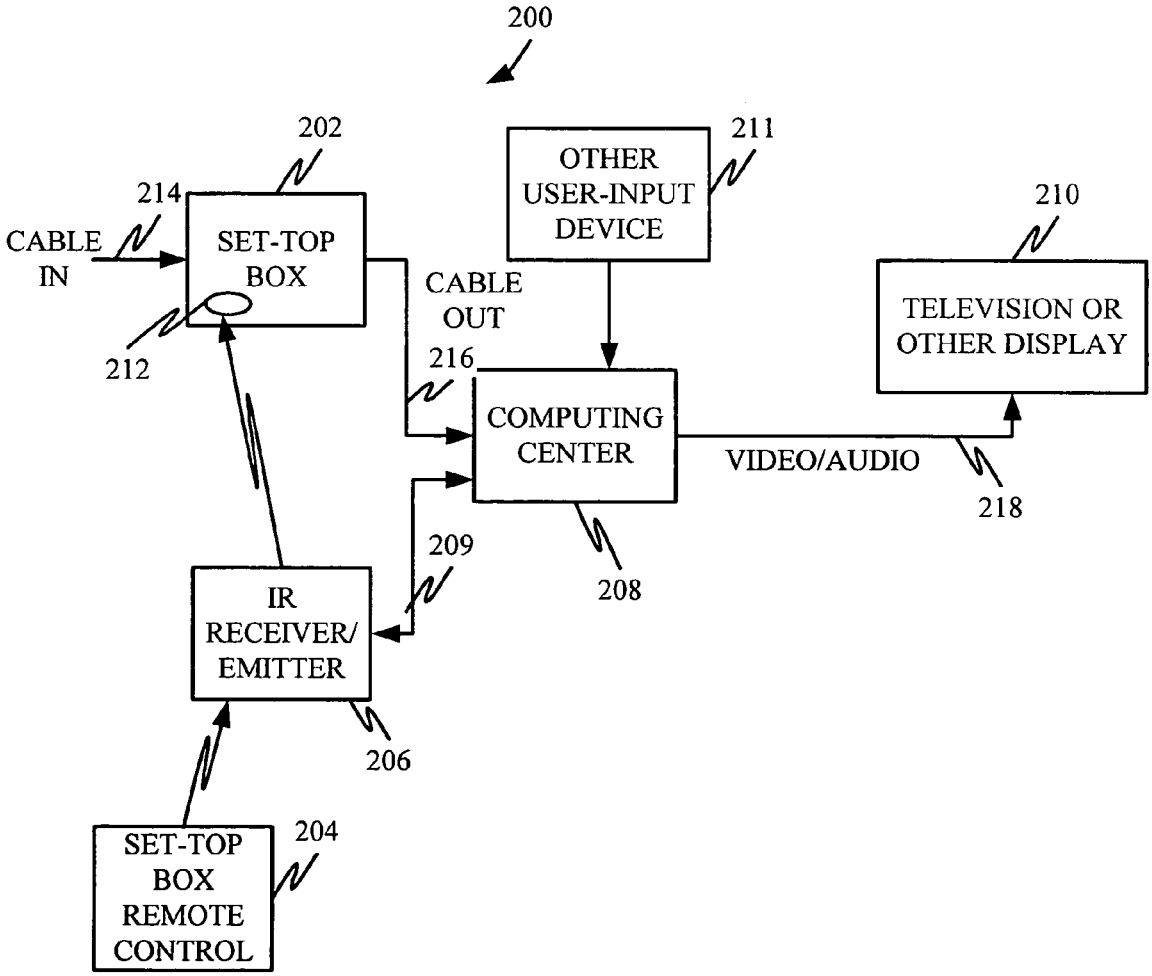
FIG. 2 is a block diagram of one illustrative environment in which the present invention can be used.

FIG. 2 is a block diagram of one illustrative media system 200 in which the present invention can be used. Media system 200 illustratively includes set top box 202, set top box remote control unit 204, infrared (IR) receiver/emitter 206, computing center 208, other user-input devices 211 for providing input to computing center 208, and display device 210.

It should be noted, of course, that display 210 can be a television set, a monitor, a plasma display, a CRT, or any other type of display device.

In the embodiment shown in FIG. 2, set top box 202 is the electronic device to be controlled. Of course, the electronic device to be controlled could be any other device that can be controlled via an IR remote control and set top box 202 is used by way of example only. Set top box 202 has a corresponding remote control unit 204 that controls set top box 202 by emitting infrared (IR) radiation that represents control codes. The IR radiation is detected by an IR receiver 212 on set top box 202. In one embodiment, the user wishes set top box 202 to be controlled by a computing center 208. Computing center 208 can illustratively take the form of the computer described with respect to FIG. 1, or it can be any other type of computing center.

Computing center 208 is illustratively coupled to an IR receiver/emitter 206 through a link 209. Link 209 can be any suitable link, and is illustratively a universal serial bus (USB) cable. However, any other link can be used as well. To control set top box 202, computing center 208 must first identify what code set is used by remote control unit 204. This is described in greater detail below.

In the illustrative media system 200 shown in FIG. 2, set top box 202 receives a cable signal via input 214, but instead of providing the cable output to television 210, it provides the cable output 216 to computing center 208. Computing center 208, in turn, provides an output 218 (such as an audio/video output or an S-video output) to television 210.

The user may wish computing center 208 to control set top box 202 for a variety of reasons. For instance, computing center 208 can illustratively contain functionality, such as audio or video recording functionality. In that case, a user can program computing center 208 to record a television program when the user is not present.

This scenario is now described to illustrate portions of the present invention, but the invention is by no means limited by this description. It will be recognized that the invention is equally applicable to any situation where a device is to identify a code set used by a remote control unit.

To record the desired television program in the user's absence, computing center 208 must have previously identified the code set used by remote control unit 204. Then, computing center 208 uses that code set to change the channel of set top box 202 to the desired channel by providing a channel change code through the emitter portion of IR receiver/emitter 206. The channel change code changes the channel of set to box 202 to the desired channel. Computing center 208 then begins recording the television program at a pre-programmed time.

Therefore, in order to manipulate the set top box 202 in this way, computing center 208 must know the particular remote control code set that is used by set top box remote control unit 204. Once that code set is known, computing center 208 can cause IR receiver/emitter 206 to simulate set top box remote control unit 204 by providing the code signals from the identified code set to set top box 202 through IR receiver/emitter 206.

Figure 3:
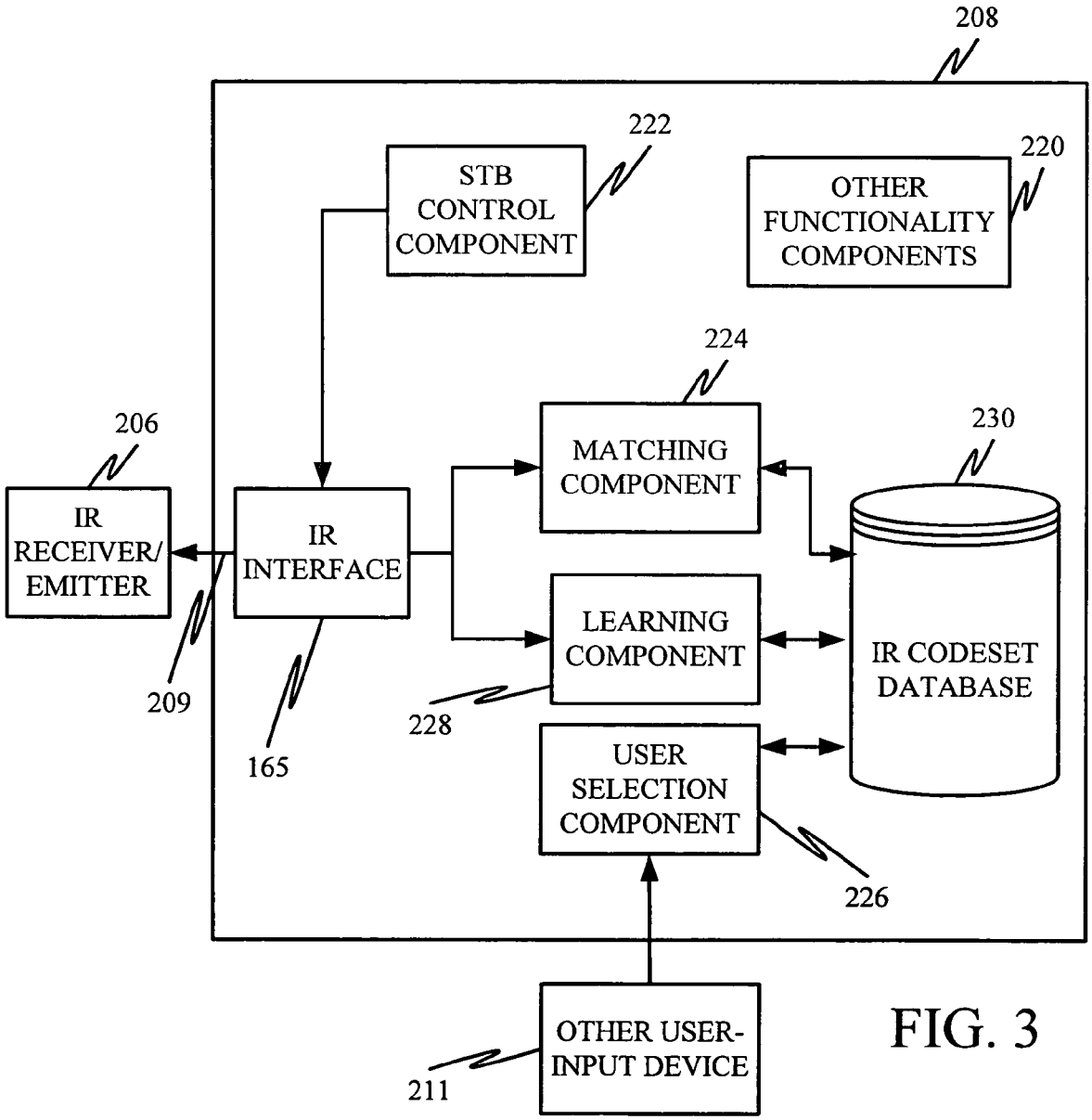
FIG. 3 is a more detailed block diagram of a media computer in accordance with embodiment of the present invention.

FIG. 3 shows a more detailed block diagram of a portion of computing center 208. The embodiment shown in FIG. 3 includes components that are utilized in identifying the code set used by set top box remote control unit 204. Of course, computing center 208 will include a variety of other functionality represented by other functionality components 220. Such components 220 will illustratively include a variety of processing and timing functionality, video and audio functionality, etc. However, these functions form no part of the present invention and will not be discussed in greater detail.

Figure 4:
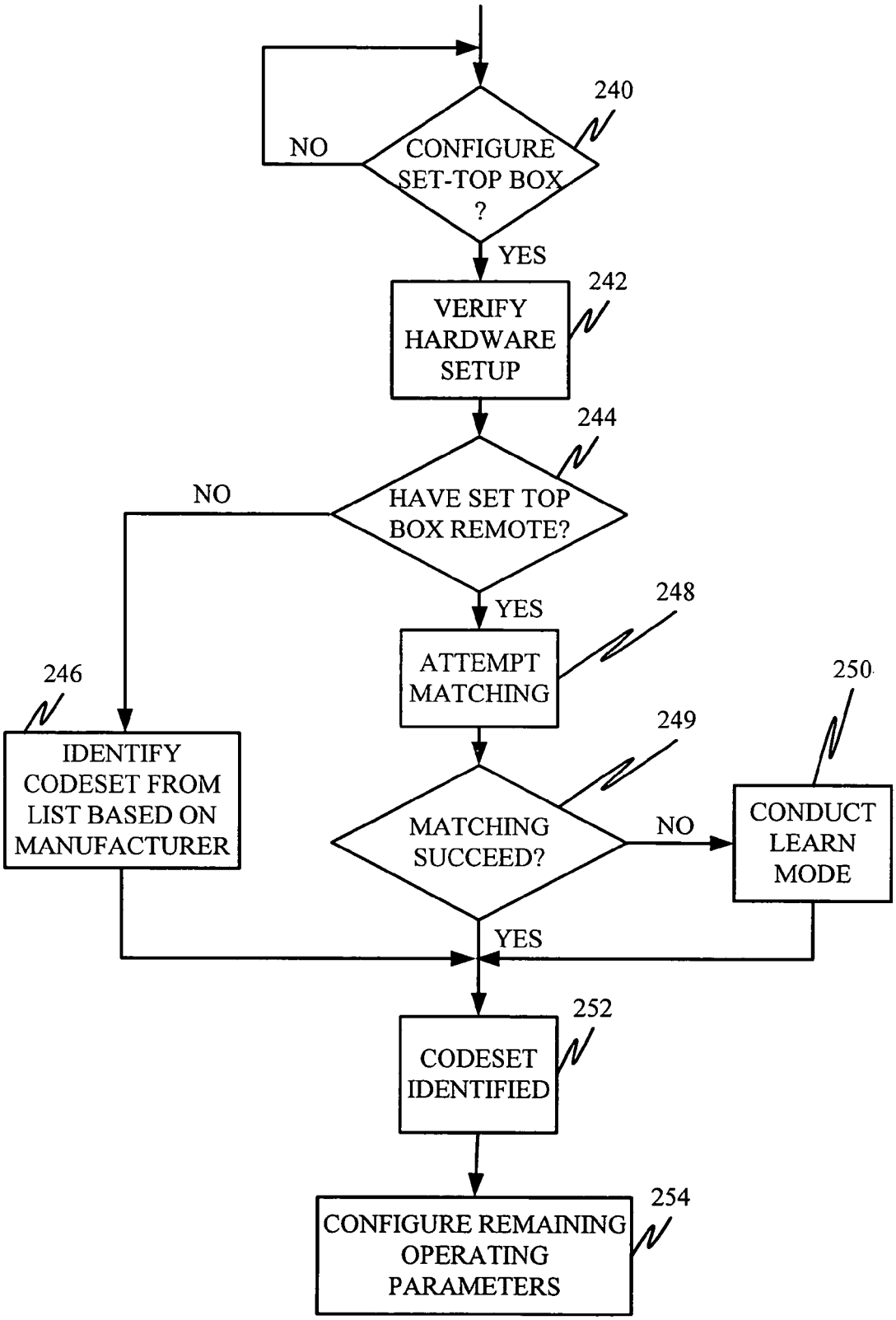
FIG. 4 is a simplified flow diagram illustrating the operation of the media computer shown in FIG. 3 in identifying a remote control code set.

FIG. 3 illustrates that computing center 208 illustratively includes IR interface 165, set top box (STB) control component 222', matching component 224, user selection component 226, learning component 228, IR code set database 230, and other user-input device 211. STB control component 222 is illustratively the component which generates digital codes that are used to control set top box 202. These digital codes are converted into analog signals by IR interface 165 and the analog signals are provided to IR receiver/emitter 206 along link 209. Matching component 224, user selection component 226 and learning component 228 can all illustratively be used in conjunction with IR code set database 230 to identify or learn a particular remote control code set used by set top box remote control unit 204 for controlling set top box 202. FIG. 4 is a simplified flow diagram illustrating how the code set can be identified by computing center 208.

In order to configure computing center 208 so that it can control set top box 202 through IR receiver/emitter 206, computing center 208 first prompts the user to indicate whether the user wishes to configure the set top box 202 for control by computing center 208. This is indicated by block 240. In order to do this, computing center 208 can inquire of the user in one of a variety of different ways. For instance, computing center 208: can simply display a user prompt, or question, on display 210 or another display device.

Computing center 208 can include its own user input device 211 for receiving user inputs. The user input device 211 can illustratively include a mouse, a keyboard, a touch sensitive screen, a keypad, a voice recognition system, a remote control etc.

When the user indicates that the user wishes to configure set top box 202 for control by computing center 208, computing center 208 then attempts to verify that the hardware set-up in the system (such as system 200 shown in FIG. 2) is accurate and all the necessary connections are made. This is indicated at block 242 in FIG. 4. In doing this, computing center 208 illustratively checks for the presence of an IR receiver and an IR emitter and prompts the user to fix problems that are detected. Optionally, computing center 208 can check for the presence of a cable television signal, a set top box signal, a satellite signal, an antenna, etc. If one or more of them are missing, computing center 208 can prompt the user to try various troubleshooting techniques in order to correct any errors in the hardware set-up. This can be done in one of a variety of different ways and does not form part of the present invention.

Figure 4A:
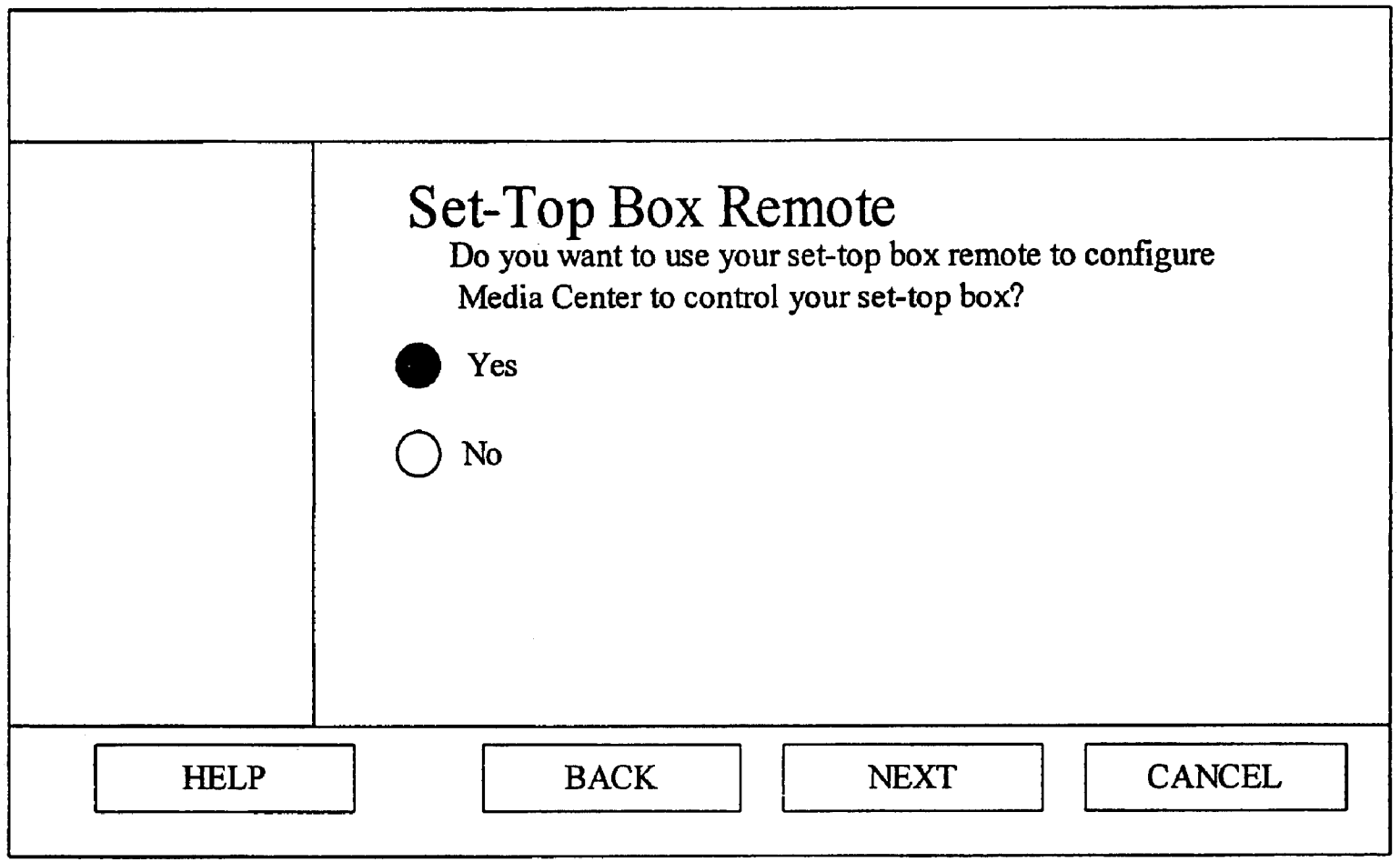
FIG. 4A is an illustrative screen shot that can be used in accordance with the flow diagram shown in FIG. 4.

At step 244, computing center 208 asks the user if they have the remote control for the electronic device to be controlled. This can be done, for instance, by generating a display such as the screen shot shown in FIG. 4A. Alternative text can also be displayed such as "We can detect how to control your set top box if you have a remote that controls the set top box. Do you have a functioning remote to match to an existing code set in the computing center?" Other or different text can of course be used as well. If they do not have the remote control, computing center 208 uses a look-up mode to identify the code set for the electronic device at step 246.

In step 246, user selection component 226 in computing center 208 prompts the user to identify a code set from a list based on the manufacturer of the electronic device to be controlled (e.g., based on the manufacturer of set top box 202). More specifically, IR code set database 230 (shown in FIG. 3) illustratively includes a list of predetermined code sets used by different manufacturers. In addition, some manufacturers may use one of a plurality of different code sets based upon the particular electronic device or the particular model of electronic device to be controlled. This list of code sets (by manufacturer) can be provided to the user in a printed index, or the index can be displayed from database 230 to the user by computing center 208 using display 210 or another suitable display. User selection component 226 then prompts the user to select the manufacturer of the device to be controlled using input device 211.

If that particular manufacturer uses a plurality of different code sets, user selection component 226 prompts the user to select one of the code sets. Based upon the user selections, user selection component 226 accesses the IR code set database 230 and retrieves the identified code set and provides it to STB control component 222. Thereafter, STB control component 222 uses the identified code set to control set top box 202 through IR receiver/emitter 206.

If, at block 244, the user indicates that they do have the remote control for the electronic device, computing center 208 uses a matching mode to attempt to match codes produced by the remote control to codes in one of the code sets at step 248. In the matching mode, matching component 224 (shown in FIG. 3) prompts the user through a matching process in order to identify the code set in IR code set database 230. This is described in greater detail below with respect to FIG. 5.

At step 249, computing center 208 determines if a code set was found using the matching mode. If the code set could not be found, computing center 208 enters a learning mode at step 250. In the learning mode, learning component 228 prompts the user through a learning process so that the computing center 208 can learn the remote control code set used by remote control unit 204. This is described in greater detail below with respect to FIG. 6.

If the matching mode identifies a code set or after step 246 or 250, a code set has been identified as indicated by step 252. Once the code set is found, the user illustratively proceeds to configure a number of remaining operating parameters of set top box 202. This is indicated by block 254 in FIG. 4. For instance, some electronic devices to be controlled receive two digits and others receive three digits from their corresponding remote control units. Similarly, some electronic devices received the required number of digits followed by an "Enter" key, while others do not. In addition, some remote control units and corresponding electronic devices expect a certain distance between digits in the infrared transmission from the remote control unit. If the digits are spaced too closely to one another, electronic device may not process the digits correctly. Therefore, these types of additional operating parameters can be set by the user at block 254. These parameters can be set in one of a variety of different known ways. However, since this does not form part of the present invention, it will not be discussed in greater detail.

Figure 5:
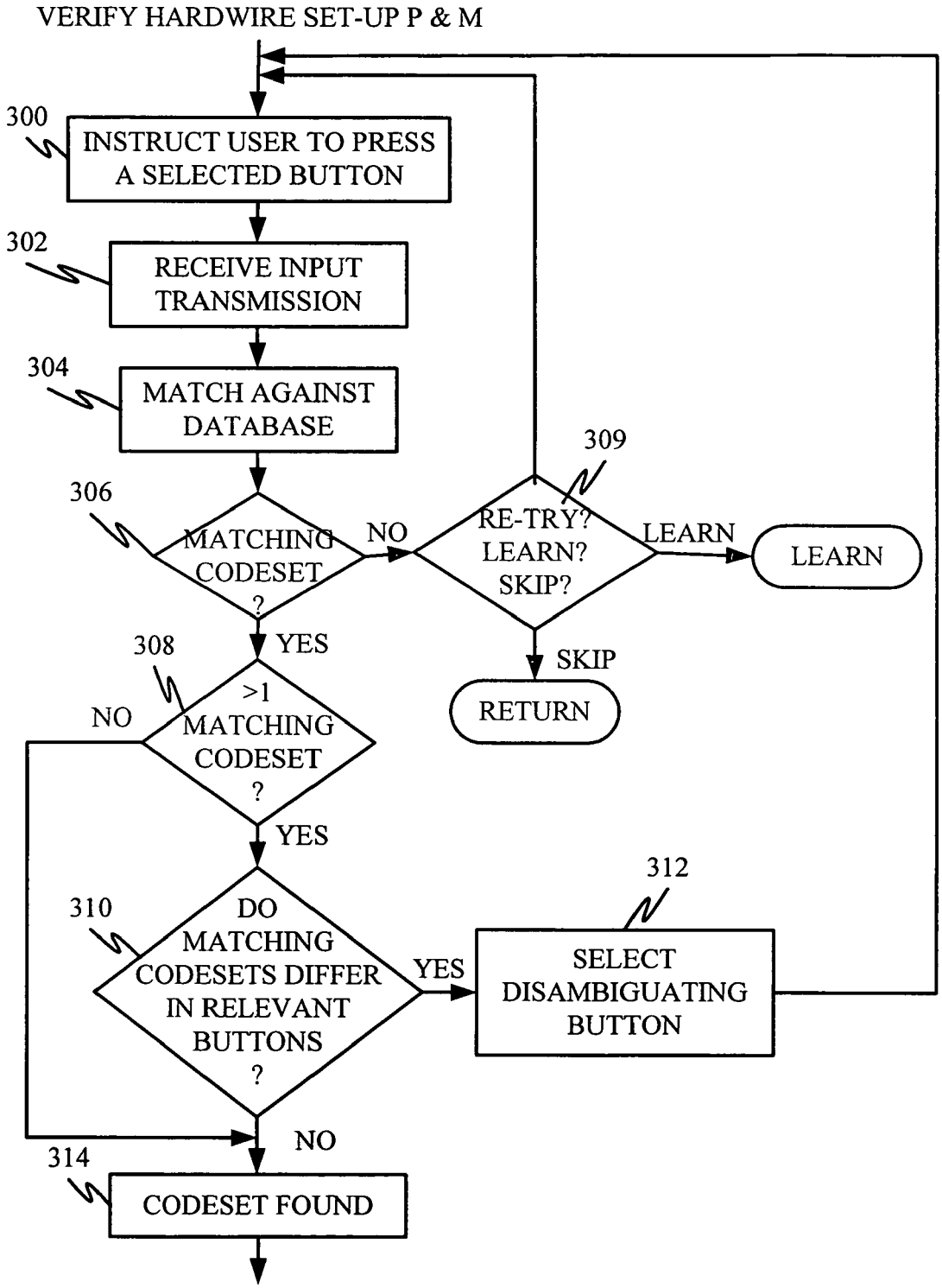
FIG. 5 is a more detailed block diagram illustrating a matching process used to match a remote control code set.

FIG. 5 is a more detailed flow diagram illustrating one embodiment of the matching mode indicated by block 248 in FIG. 4.

Figure 5A:
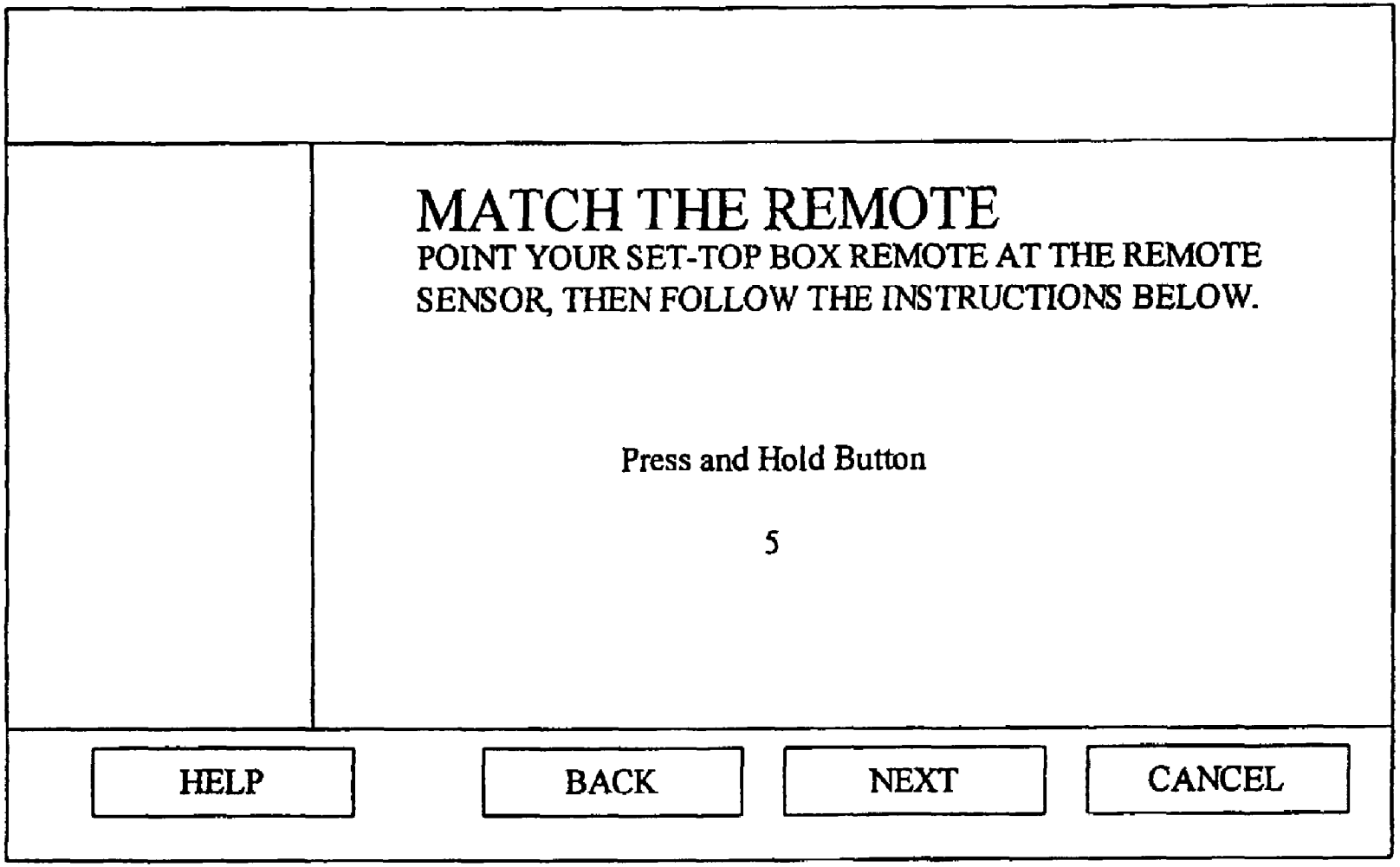
FIGS. 5A-5C are illustrative screen shots that can be used in accordance with the flow diagram shown in FIG. 5.

In step 300 of FIG. 5, matching component 224 instructs the user to press a selected button. Again, this can be done by simply generating a display such as the screen shot shown in FIG. 5A. It can be seen that the user is being instructed to press and hold the five button. Of course, alternative text can be used as well. One embodiment of alternative text includes "To help us match your remote, you will press and hold the number x using your set top box remote. Point the remote directly at the remote sensor. When the computing center is finished analyzing and matching the button, you will be asked to release the button. We will repeat this process up to three times to accurately capture the data."

Once the user has pressed the button, matching component 224 receives the input transmission from IR receiver/emitter 206 through IR interface 165. This is indicated by block 302 in FIG. 5.

It should be noted that in the illustrative embodiment, the transmission received is simply the overall waveform of the infrared transmission sent by the set top box remote control unit 204. The overall waveform is indicative of a code corresponding to the depressed button. Matching component 224 attempts to match that data against corresponding codes for the depressed button in the IR code set database 230.

In other words, if the user is instructed to depress the five button, the code represented by the infrared transmission corresponding to that button depression is captured by matching component 224 and is matched against the various code sets in database 230. This matching is indicated by block 304 in FIG. 5. Matching component 224 thus identifies any code sets in database 230 that have the same code as that received from remote control unit 204. Under one embodiment, it does not matter if the code is associated with the same button that the user was instructed to press. This is done so that if the user mistakenly pressed the wrong button, a match for the code can still be found. Determining whether there are any code sets that match the input just received is indicated by block 306 in FIG. 5.

If no matching code sets are located, matching component 224 determines whether the user wishes to re-try the process, switch to the learning mode, or simply skip this portion of the set up. This is indicated by block 309.

The user may wish to re-try the matching process for a number of reasons. For instances, many remote control units can operate in different modes. They can operate in a mode to control a television set, to control an audio device, and to control a set top box, for instance. Therefore, the user may notice that the remote control unit was in the wrong mode when the matching process was attempted. In that case, the user may simply wish to re-try the matching process and processing reverts back to block 300.

Alternatively, the user may wish to simply skip this portion of the set up routine or the user may wish to attempt the learning mode. If the learning mode is selected, then processing switches to the flow diagram shown in FIG. 6, which is described in greater detail below.

Figure 5B:
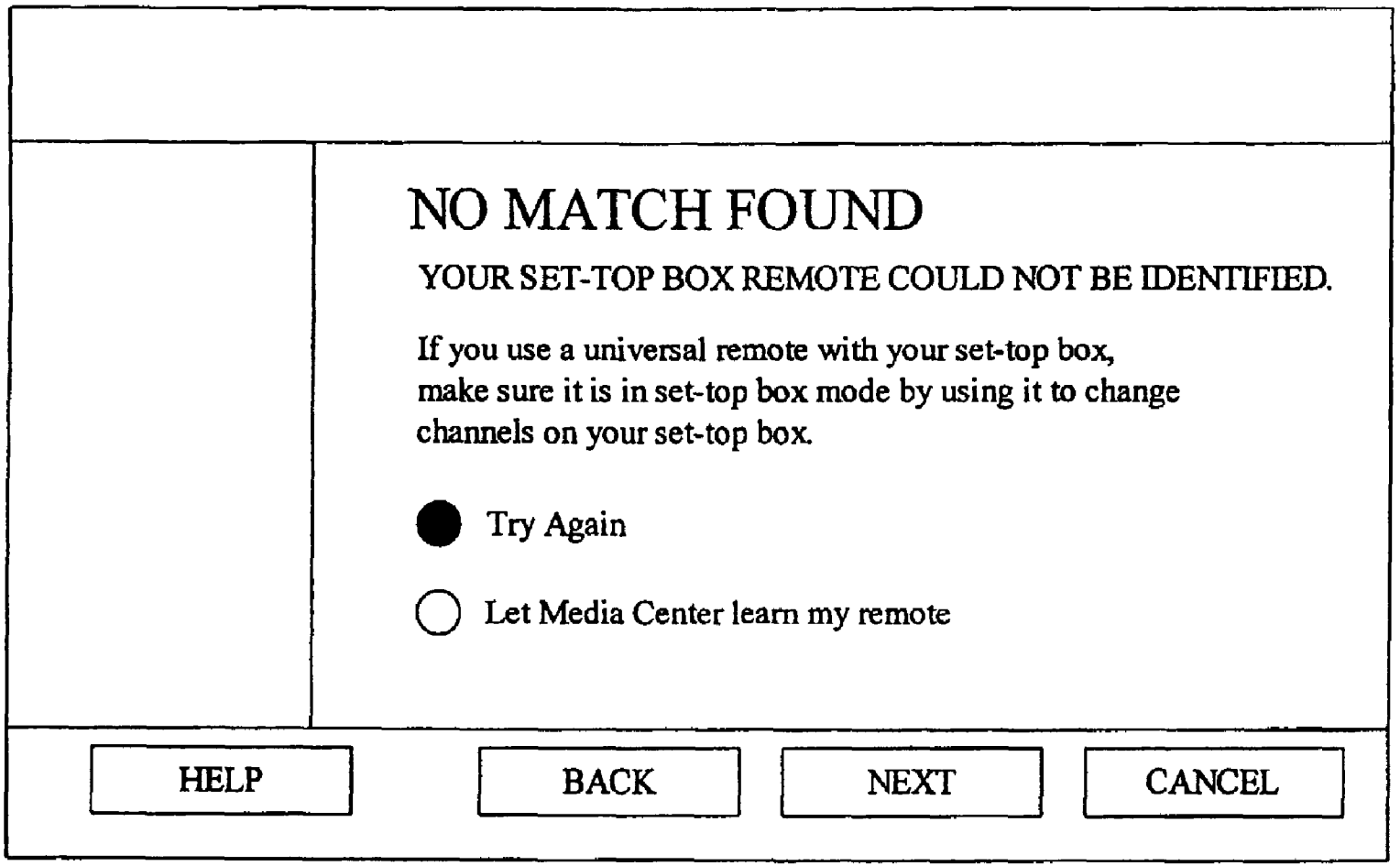

If, at block 309, no match has been found, then one way for requesting the user to indicate whether the user wishes to re-try the matching process, go to the learning process, or skip this portion of the set up routine, is by providing a display to the user, such as the screen shot shown in FIG. 5B. Alternative text can be displayed as well such as: "We were unable to match your set top box remote. If you have a multi-functioning remote, please check now to ensure it is in set top box mode by changing channels with it on the set top box. Please see help for more troubleshooting." Thus, it is clear that matching component 224 can ask the user to choose whether to re-try matching, learn mode or skip, and matching component 224 can also suggest trouble shooting options to the user as well.

If, at block 306, matching component 224 has identified at least one code set in database 230 that contains a matching code for the number five button, then matching component 224 determines whether more than one matching code sets have been identified. This is indicated by block 308 in FIG. 5. For instance, a plurality of different code sets may have the same code for the number five button, but differ with respect to other buttons. Therefore, if multiple matching code sets are identified, then matching component 224 determines whether the matching code sets differ with respect to any relevant buttons.

By way of example, assume that three different code sets were identified as having the same code for the number five button. Assume also that the only buttons which will be controlled by computing center 208 on set top box 202 are the number buttons, the channel up/channel down buttons and the page up/page down buttons. However, the remote control unit being used by the user may have many additional keys which will not be used by computing center 208 in controlling set top box 202. Matching component 224 thus determines whether the three matching code sets which were identified are the same with respect to all of the relevant buttons, or whether they contain differences with respect to those buttons. This is indicated by block 310. If they are the same, then it does not matter which code set is chosen for use by computing center 208, since all will result in the correct code for the relevant buttons.

However, if the three matching code sets have different codes with respect to one or more of the relevant buttons, then computing center 208 analyzes the codes to identify, if possible, a disambiguating code. For instance, assume that all three of the matching code sets have identical codes for the numerical buttons, but they all have different codes for the page up button. In that case, matching component 224 identifies the page up button as a disambiguating button. This is indicated by block 312 in FIG. 5.

Processing then reverts back to block 300 where the user is prompted to press the selected button (which is now the disambiguating button—the page up button). Matching component 224 then receives the code associated with the disambiguating button and matches it against the three identified code sets that were identified during the first matching process. Matching component 224 determines which of those three code sets actually corresponds to the remote control unit 204 being used by the user. Of course, this process can be iterated on in order to narrow down the code sets that are matching, if necessary.

In an alternative embodiment, the user is automatically switched to the learning mode if a threshold number of matching processes have been attempted. For example, if the user has input three different buttons and matching component 224 still cannot disambiguate among the codes, then matching component 224 may suggest to the user that the user enter the learning process.

In any case, assuming that matching component 224 was able to identify a uniquely matching code set from the code sets contained in database 230, matching component 224 will have found a code set as indicated by block 314 in FIG. 5. That code set is provided to STB control component 222 which thereafter uses the identified code set in controlling set top box 202.

Figure 5C:
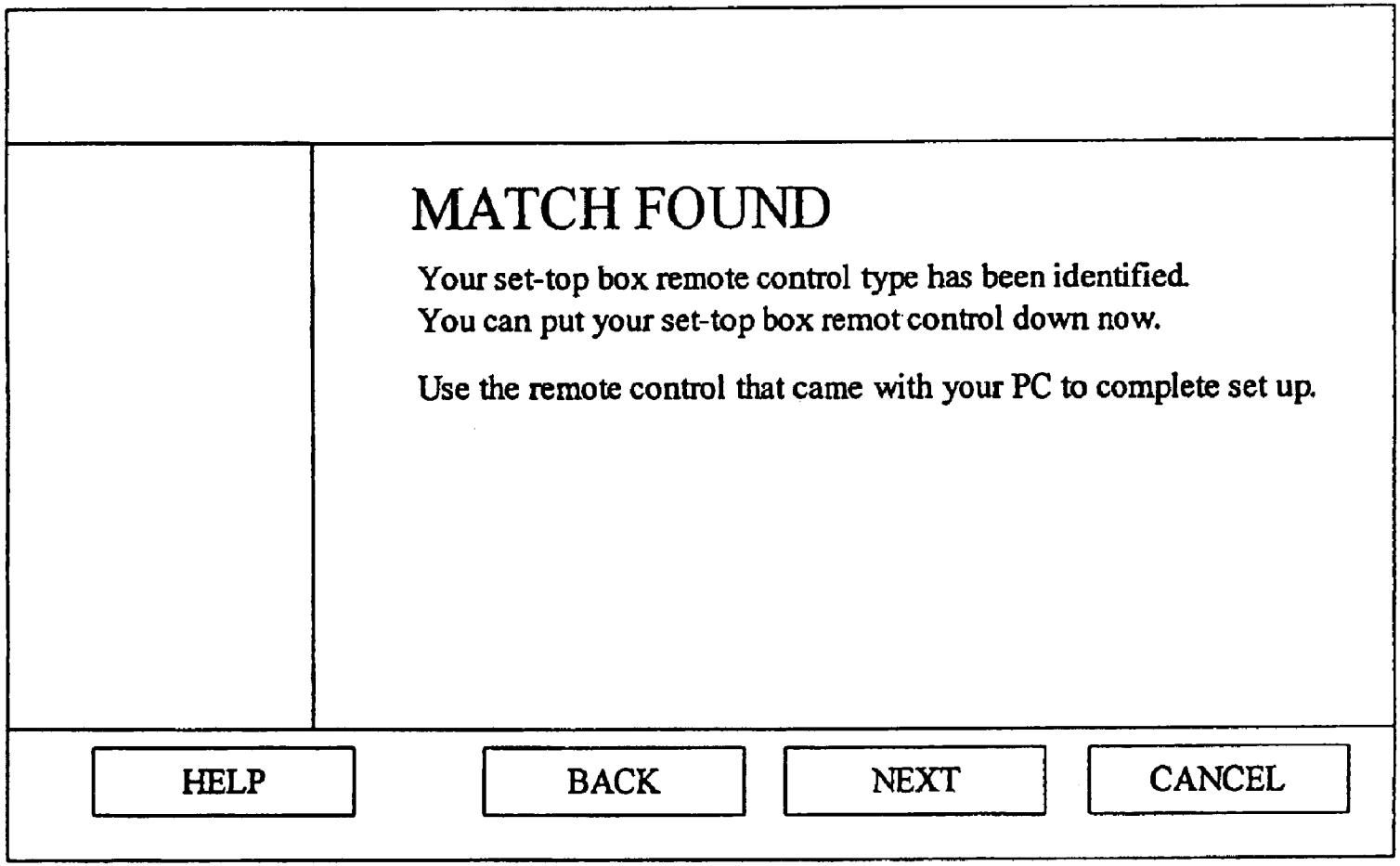

When the match has been found as indicated at block 514, matching component 234 can indicate this to the user by displaying a screen shot, such as that shown in FIG. 5C. Alternate text can be used as well, such as "We have successfully matched your set top box remote! We will now proceed through the rest of the set top box set up. Please pick up your computing center remote."

Figure 6:
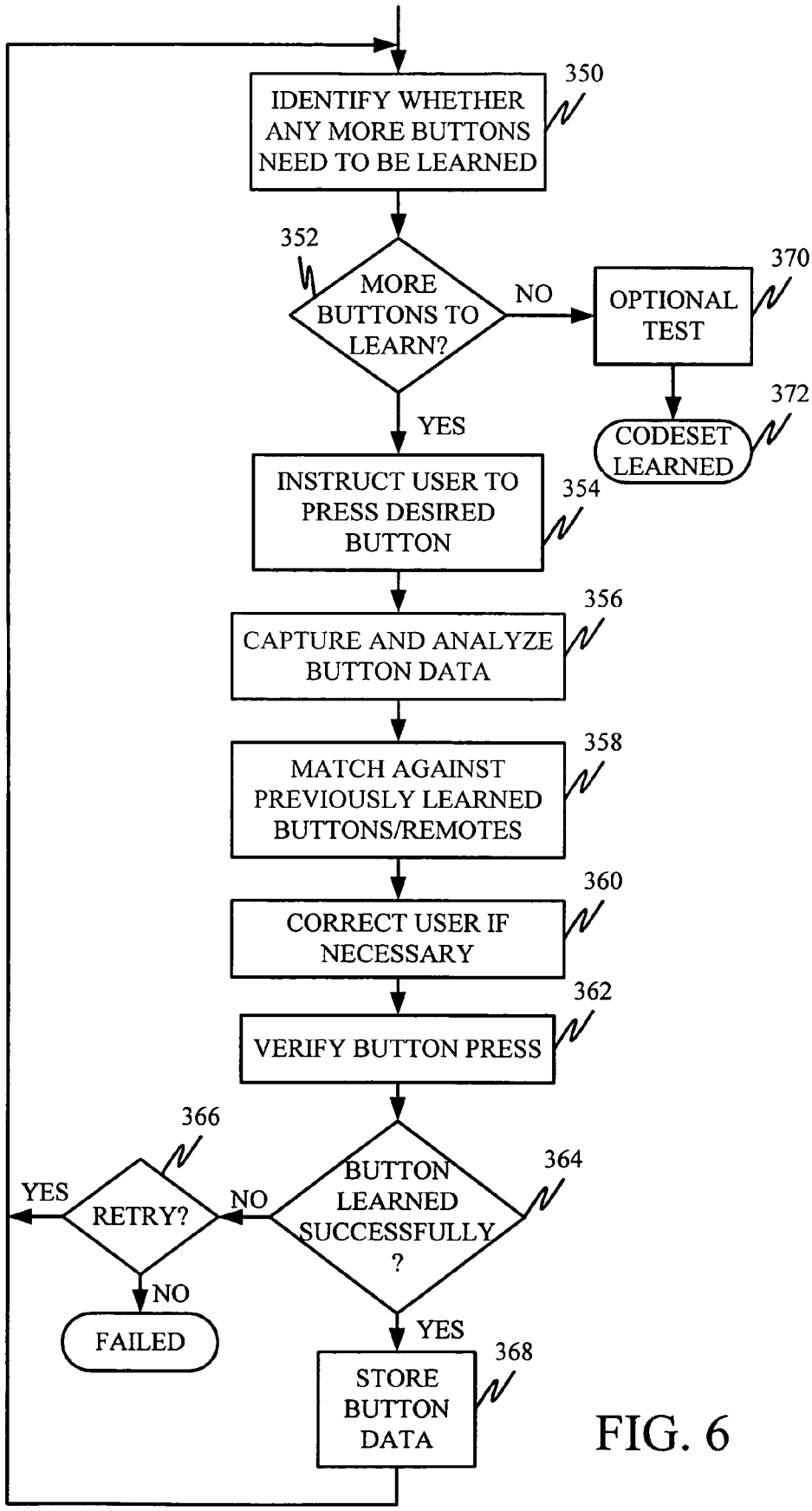
FIG. 6 is a more detailed flow diagram illustrating a learning process used to learn a remote control code set in accordance with one embodiment of the present invention.

FIG. 6 is a flow diagram illustrating the learning mode in accordance with one embodiment of the present invention. If the user enters the learning mode, learning component 228 in computing center 208 first determines whether the code data for any buttons needs to be learned. This is indicated by block 350 in FIG. 6.

Figure 6A:
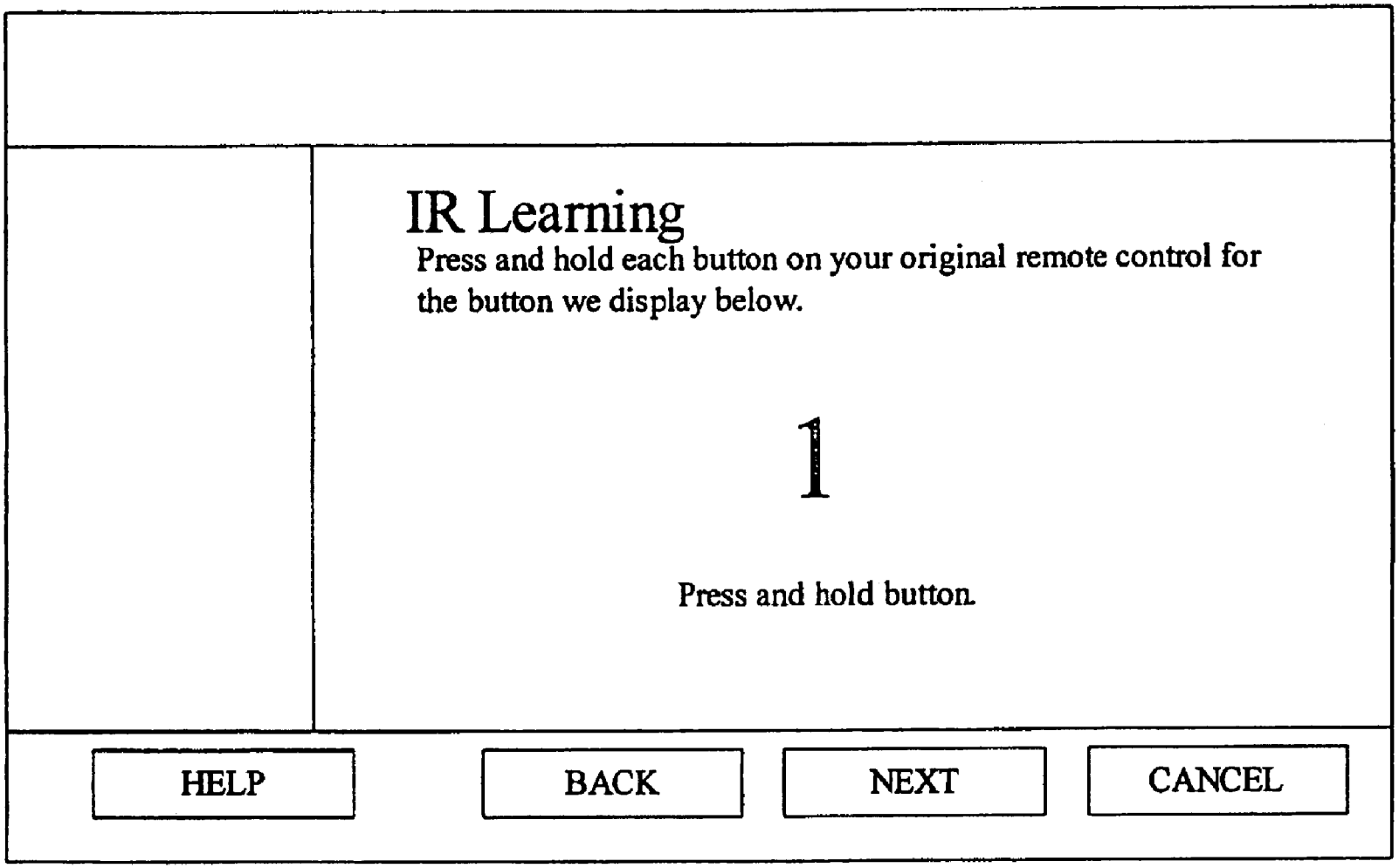
FIGS. 6A and 6B are illustrative screen shots which can be used in accordance with the flow diagram shown in FIG. 6.

If there are more buttons still to learn, as indicated by block 352, the user is instructed to press one of the buttons which must be learned. This is indicated by block 354 in FIG. 6. One illustrative way in which learning component 228 asks this of the user is to display a screen shot, such as that shown in FIG. 6A. Of course, alternative text can be displayed prior to or along with the screen shot shown in FIG. 6A such as "To help us learn your remote, we will prompt you to press and hold a series of buttons, one at a time, using your original remote. When we are finished analyzing and storing the button, we will prompt for the next button. Press and hold each button as it is highlighted. When the highlighted button is flashing, press that button on your original set top box remote, while pointing your remote at the infrared receiver/emitter."

Once the user has been instructed to press a button, learning component 228 uses known circuitry to capture and analyze the button data received over IR receiver/emitter 206 for the corresponding button. This is indicated by block 356 in FIG. 6. In this step, learning component 228 simply performs a known learning process by which the carrier frequency is detected, the overall waveform is detected, the spacing between pulses is detected, and all other detailed parameters corresponding to the code for the depressed button are learned.

However, in accordance with one embodiment of the invention, learning component 228 also illustratively matches against previously learned buttons and remote control units. For instance, assume that learning component 228 has instructed the user to depress the number five button. Assume also that the user has erroneously depressed the number two button, but learning component 228 has already learned the code corresponding to the number two button. In one embodiment, learning component 228 matches the data for the currently depressed button against data corresponding to already learned buttons. This is indicated by block 358 in FIG. 6. In doing this, learning component 228 identifies the fact that the user is actually depressing the number two button instead of the number five button. Learning component 228 can then correct the user by displaying a message stating that the user is erroneously depressing the number two button and requesting that the user depress the number five button. Prompting the user for a correct input is indicated by block 360 in FIG. 6.

This process can also be used to identify whether the user is using an incorrect remote control unit. For instance, if the user is using the remote control unit corresponding to computing center 208, learning component 228 identifies that the button being depressed has a code which corresponds to the code for the remote control computing center 208. At block 360, learning component 228 can illustratively provide a display to the user stating that the user is using the wrong remote control unit and requesting the user to pick up and use the set top box remote control unit.

In any case, once the user has depressed the correct button on the correct remote control unit, and the code data has been captured and analyzed, learning component 228 verifies the data by requesting the user to stop depressing that button and to depress the same button again. Learning component 228 then repeats the matching steps above and determines whether the data corresponding to the second pressing of the button matches the data corresponding to the first pressing of the button. If not, that may mean that the user depressed the incorrect button the first time and the user can be prompted to depress it again for verification. However, if the data corresponding to both button depressions is the same, then learning component 228 has verified that the user has depressed the correct button, and that learning component 228 has learned data for the correct button. Verifying the button press is indicated by block 362 in FIG. 6.

It may be that, at block 262, learning component 228 determines that it has not learned the button successfully. This can happen for a number of reasons. For instance, the user may not be properly aligning the remote control with IR receiver/emitter 206, or the user may have wavered during the button depression so the two are out of alignment, etc. In any case, if the button was not learned successfully, learning component 228 can display a message to the user, such as on display 210, asking whether the user wishes to attempt to re-learn the button. Determining whether the button was learned successfully and requesting whether the user wishes to re-try the learning process is indicated by blocks 364 and 366.

If, at block 364, it is determined that the button was learned successfully, then learning component 228 stores the data corresponding to the newly learned button in database 230 for later use by STB control component 228 in controlling set top box 202. This is indicated by block 368 in FIG. 6.

When, at block 352, it is determined that there are no more buttons to learn, learning component 228 can conduct an optional test. This is indicated by block 370 in FIG. 6. For instance, learning component 228 can request STB control component 222 to attempt to change the channel of set top box 202 to ensure that the learned code is working adequately. If so, or if the optional testing at 370 is not performed, the code set is stored in IR code set database 230 for use by STB control component 222. This is indicated by block 372 in FIG. 6.

Figure 6B:
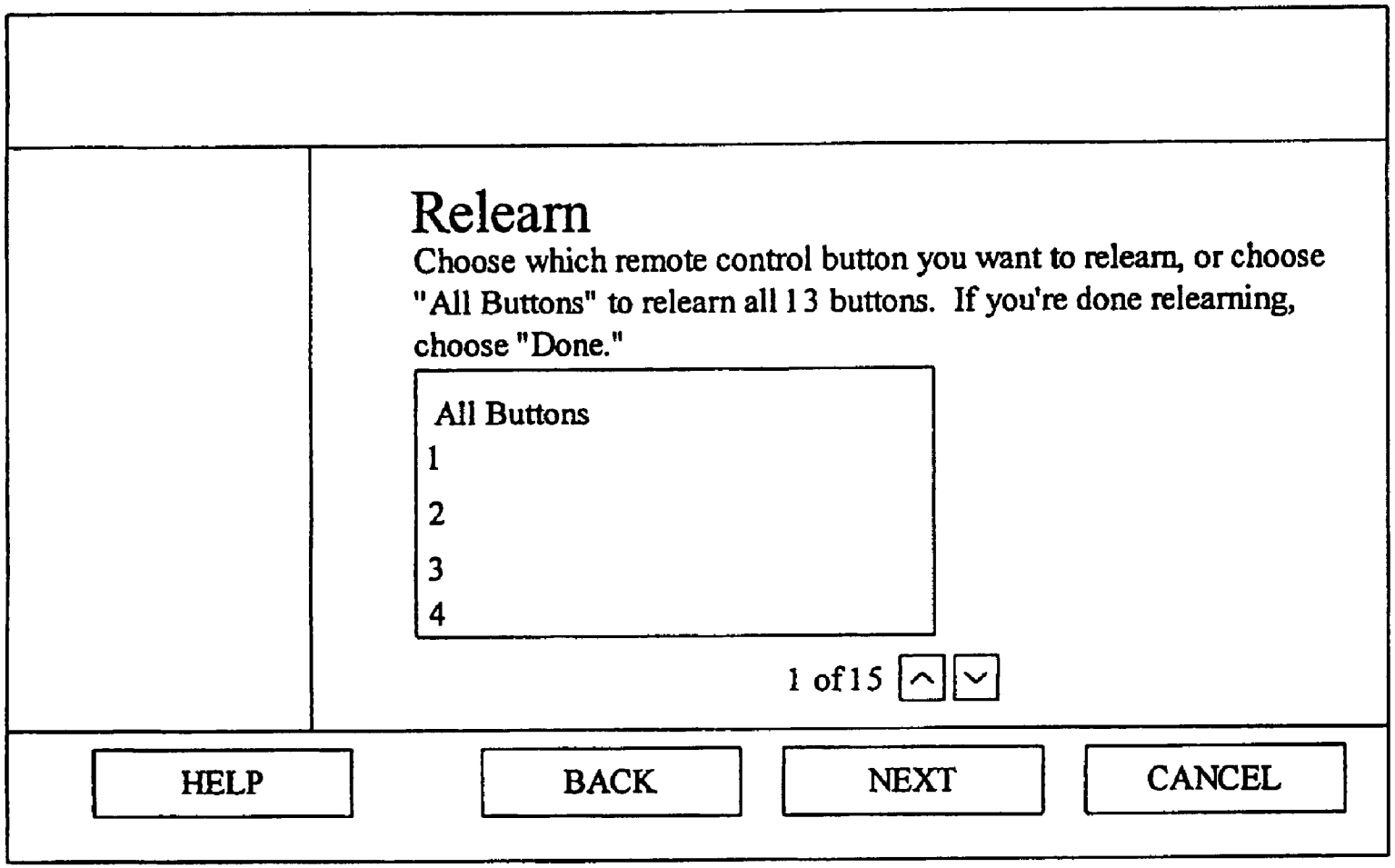

It should also be noted that, during later operation of system 200, the user may wish to change code sets, to modify the learned code set, or to relearn certain buttons. In that instance, component 228 can display to the user a suitable screen shot, such as that shown in FIG. 6B. It can be seen that the screen shot of FIG. 6B allows the user to select which buttons are to be relearned, or to select all buttons for relearning.

It can thus be seen that various embodiments of the present invention significantly enhance the user experience in configuring an electronic device to be controlled. First, in one embodiment, the learning process is performed on a computing device, rather than on a remote control unit. This allows the learning process to be preformed more quickly and accurately.

Similarly, the present invention provides a learning process which verifies button depressions and prompts the user to correct erroneously depressed buttons. This more likely ensures that the learning process will be completed accurately, without requiring the user to wait until the end of the learning process only to discover that it was done inaccurately and must be repeated.

Also, in one embodiment, the learning process compares data corresponding to a button depressed against already learned buttons and remote controls in order to identify potential errors being committed by the user. Again, this enhances the user experience in that it shortens the overall time required for the learning process to be performed.

In addition, the matching process used in accordance with one embodiment of the invention allows a code set to be chosen in a very quick and easy way when compared with prior art techniques. The user simply needs to point the remote control at the IR receiver/emitter 206 and depress a single button. The overall waveform that represents the data corresponding to the code for that button is captured and the code is compared against the code for that button in the plurality of code sets stored in database 230.

Many times, only a single code set will have a matching code for the depressed button and the code set will be identified instantly, after only a single button depression by the user. In those instances where the code corresponding to the depressed button matches more than one code set in database 230, the present invention examines the matching codes for a disambiguation button and requests that the user press the disambiguation button so that the ambiguous matching codes can be quickly disambiguated with the fewest number of button depressions required.

Similarly, the matching process performs matching only on the code associated with a button depression that is represented by the overall waveform of the IR transmission, and not on all of the detailed code set data (such as the carrier frequency, the symbol spacing, etc.). Therefore, the code set can generally be identified from in excess of a foot of separation between the remote control unit and the IR receiver. In fact, it can be identified with in excess of two feet of separation, in excess of five feet of separation, in excess of ten feet of separation and indeed, up to any operable range for the remote control unit. This is in sharp contrast to prior art IR learning modes which require the remote control unit to be positioned closely adjacent, and in accurate alignment with, the learning component so that all of the detailed code set information and parameters could be captured and learned.

It will also be appreciated that some remote control units include a toggle bit. This is a bit, typically at the start of a code, that toggles each time the code is transmitted by the remote control unit. This enables the receiving device to distinguish between a continuous button depression and two successive depressions of the same button. The present invention deals with this, when verifying an input or matching a code, by either simply ignoring the toggle bit entirely or by prompting the user for three successive depressions of the same button and using only the first and third samples, which should be identical. Also, to identify the toggle bit, the present invention can prompt the user for two successive button depressions and then compare the codes associated with those depressions. They will differ by only a single bit and that bit can thus be identified as the toggle bit.

Although the present invention has been described with reference to particular embodiments, workers skilled in the art will recognize that changes may be made in form and detail without departing from the spirit and scope of the invention.

What is claimed is:

1. A method of identifying a code set used by a remote control unit for controlling an electronic device, comprising:

receiving a transmission, representing a code that identifies a first user input, from the remote control unit, the first user input being one of a plurality of different user inputs having codes that can be transmitted by the remote control unit, each different user input corresponding to a different operation to be performed by the electronic device;

comparing the code against a plurality of stored code sets each stored code set having a plurality of stored codes, wherein each of the plurality of stored codes in each stored code set corresponds to one of the different operations to be performed by the electronic device;

identifying, as a matching code set, a stored code set having a stored code matching the code received from the remote control unit that identifies the first user input;

wherein identifying a stored code set as a matching stored code set further comprises:

determining whether there is more, than one matching code set;

if there is more than one matching code set, then determining whether any of the matching code sets have a disambiguating code for a subsequent user input that differs between at least two of the matching code sets for the subsequent user input;

if one of the matching code sets has a disambiguating code, then prompting the user for the subsequent user input corresponding to the disambiguating code;

receiving the disambiguating code from the user based on the subsequent user input; and comparing the disambiguating code against the matching code sets to disambiguate at least two of the matching code sets; and controlling the electronic device to perform the plurality of different operations based on received codes in the matching code set.

2. The method of claim 1 wherein the step of identifying the code set includes identifying only one stored code set having a stored code matching the code for the first user input and storing the matching code set for use in controlling the electronic device.

3. The method of claim 1 wherein receiving a transmission comprises receiving a wireless transmission.

4. The method of claim 3 wherein receiving a wireless transmission comprises receiving an infrared transmission.

5. The method of claim 4 wherein matching the code comprises:

obtaining the code based on an overall wave shape of the infrared transmission.

6. A system for identifying a code set used to remotely control a device to be controlled, comprising:

a computing device operable to identify the code set using at least three different modes, the code set including a plurality of codes, each code corresponding to a different operation performed by the device to be controlled, the computing device configured to:

select a mode of identifying the code set from the at least three different modes of identifying the code set, the three different modes comprising a user selection mode for receiving a user selection of the code set, a code set matching mode for matching a code input by a user to one of a plurality of different stored code sets, and a learning mode for learning the code set; and identify the code set used to remotely control the device based on the selected mode; and the computing device being further configured to control the device to be controlled using the identified code set.

7. The system of claim 6 wherein the computing device comprises:

a user selection component for identifying the code set based on user selection of the code set.

8. The system of claim 6 wherein the computing device comprises:

a learning component configured to learn the code set based on input of the code set from a remote control unit.

9. The system of claim 6 wherein the computing device comprises:

a matching component for matching the code input by the user to the one of the plurality of stored code sets to identify a matching code set.

10. A system for identifying a code set used by a remote control unit for controlling an electronic device, comprising:

a matching component configured to match a code, received from the remote control unit based on a first user input, against a plurality of stored code sets each having a plurality of codes corresponding, respectively, to a plurality of different user inputs provided by the remote control unit, each different user input corresponding to a different operation performed by the electronic device, and identify, as a matching code set, a code set having a matching code corresponding to the first user input, the matching component being further configured to determine whether there is more than one matching code set, and if so, to determine whether any of the matching code sets have a disambiguating code corresponding to a second user input that differs between at least two of the matching code sets for the second user input, and if any of the matching code sets have a disambiguating code, the matching component being configured to prompt the user for the second user input corresponding to the disambiguating code; and after identifying the matching code set, the matching code set being used to control the electronic device for subsequent user inputs from the same remote control unit, without identifying the matching code set for the subsequent user inputs.

11. The system of claim 10 and further comprising:

a receiver, coupled to the matching component, configured to receive a transmission, representing the code for the first user input, from the remote control unit.

12. The system of claim 11 and further comprising:

a database, accessible by the matching component, storing the plurality of stored code sets.

13. The system of claim 12 and further comprising:

a control component configured to control the electronic device based on the matching code set.

14. The system of claim 10 wherein the matching component is further configured to receive the disambiguating code from the user based on the second user input, and match the disambiguating code against the matching code sets to disambiguate at least two of the matching code sets.

15. The system of claim 11 wherein the receiver comprises a wireless receiver.

16. The system of claim 15 wherein the wireless receiver comprises an infrared receiver.

17. The system of claim 15 wherein the code received from the remote control unit is represented by an overall wave shape of a wireless transmission received by the wireless receiver.

18. The system of claim 17 wherein the matching component is configured to perform matching based on a code received by the wireless receiver from a remote control unit located in excess of a foot from the wireless receiver.

19. The system of claim 17 wherein the matching component is configured to perform matching based on a code received by the wireless receiver from a remote control unit located in excess of 2 feet from the wireless receiver.

20. The system of claim 17 wherein the matching component is configured to perform matching based on a code received by the wireless receiver from a remote control unit located in excess of five feet from the wireless receiver.

21. The system of claim 17 wherein the matching component is configured to perform matching based on a code received by the wireless receiver from a remote control unit located in excess of ten feet from the wireless receiver.

22. The system of claim 17 wherein the matching component is configured to perform matching based on a code received by the wireless receiver from a remote control unit located within any operable range of the wireless receiver.

* * * * *

UNITED STATES PATENT AND TRADEMARK OFFICE

CERTIFICATE OF CORRECTION

PATENT NO. : 7,429,932 B1
APPLICATION NO. : 10/881618
DATED : September 30, 2008
INVENTOR(S) : Mark St. John Newell et al.

It is certified that error appears in the above-identified patent and that said Letters Patent is hereby corrected as shown below:

In column 14, line 48, in Claim 1, delete “more,” and insert -- more --, therefor.

Signed and Sealed this
Third Day of May, 2011

David J. Kappos

David J. Kappos
*Director of the United States Patent and Trademark Office*